US009393614B2

(12) United States Patent
Lorento

(10) Patent No.: US 9,393,614 B2
(45) Date of Patent: Jul. 19, 2016

(54) MOULD FOR THE CONTINUOUS CASTING OF METALS

(71) Applicant: KME Germany GmbH & Co. KG, Osnabrück (DE)

(72) Inventor: Donald Peter Lorento, Ontario, CA (US)

(73) Assignee: KME GERMANY GMBH & CO. KG, Osnabrück (DE)

( * ) Notice: Subject to any disclaimer, the term of this patent is extended or adjusted under 35 U.S.C. 154(b) by 0 days.

(21) Appl. No.: 13/865,612

(22) Filed: Apr. 18, 2013

(65) Prior Publication Data

US 2013/0277006 A1 Oct. 24, 2013

Related U.S. Application Data

(60) Provisional application No. 61/635,485, filed on Apr. 19, 2012.

(51) Int. Cl.
*B22D 11/00* (2006.01)
*B22D 11/04* (2006.01)

(52) U.S. Cl.
CPC ..... *B22D 11/00* (2013.01); *B22D 11/04* (2013.01); *B22D 11/0406* (2013.01)

(58) Field of Classification Search
CPC ..... B22D 11/00; B22D 11/04; B22D 11/041; B22D 11/0406
USPC ..... 164/418, 459
See application file for complete search history.

(56) References Cited

U.S. PATENT DOCUMENTS

| | | | |
|---|---|---|---|
| 4,207,941 | A | 6/1980 | Shrum |
| 5,797,444 | A | 8/1998 | Villanueva et al. |
| 7,455,098 | B2 | 11/2008 | Wober et al. |
| 2007/0125511 | A1 | 6/2007 | Wober et al. |

FOREIGN PATENT DOCUMENTS

| | | | |
|---|---|---|---|
| CN | 1137429 | A | 12/1996 |
| EP | 0 730 923 | | 9/1996 |
| EP | 0 875 312 | | 11/1998 |
| EP | 0 958 871 | A1 | 1/2010 |
| ES | 2 218 901 | | 11/2004 |
| GB | 879437 | | 10/1961 |
| JP | 49-143411 | U | 12/1974 |
| JP | 5-76653 | U | 10/1993 |
| JP | 8-187552 | A | 7/1996 |
| JP | 9-239496 | A | 9/1997 |
| WO | WO 01/83137 | | 11/2001 |

*Primary Examiner* — Kevin P Kerns
*Assistant Examiner* — Steven Ha
(74) *Attorney, Agent, or Firm* — Henry M. Feiereisen LLC

(57) ABSTRACT

A continuous casting mold for casting a strand of metal includes a sidewall having an inner circumference to define a mold cavity which has a pouring opening for liquid metal and an outlet opening for a cast strand. The mold cavity has a cross section sized to correspond to a basic shape of the cast strand. The sidewall is provided with a profiling in the form of a corrugation that extends in a casting direction and forms grooves extending in substantial parallel relationship from the pouring opening to the outlet opening of the mold cavity. A ratio of the inner circumference of the mold cavity to a width of each of the grooves is greater than 30, and the width of the groove is in the range of 1.5 mm to 30 mm.

17 Claims, 4 Drawing Sheets

MOULD FOR THE CONTINUOUS CASTING OF METALS

CROSS-REFERENCES TO RELATED APPLICATIONS

This application claims the benefit of prior filed U.S. provisional Application No. 61/635,485, filed Apr. 19, 2012, pursuant to 35 U.S.C. 119(e), the content of which is incorporated herein by reference in its entirety as if fully set forth herein

BACKGROUND OF THE INVENTION

The present invention relates to a mould for the continuous casting of metal.

The following discussion of related art is provided to assist the reader in understanding the advantages of the invention, and is not to be construed as an admission that this related art is prior art to this invention.

Moulds of copper or copper alloys for the continuous casting of sections of steel or other metals having a high melting point have been described many times in the related art. Ideally, a cast strand produced by continuously casting steel should have the shape of the mould from which it was cast, it being slightly smaller than the mould due to the contraction of the metal being cast. On occasion this shape is lost and this often results in cracks and tears in the solid section. This problem becomes worse when casting steel having a carbon content between 0.2 and 0.4 mass percentage. In this carbon content range there is a marked tendency for a square or rectangular configuration to become rhomboid. It has been shown that as the rhomboidal configuration of the cast strand increases and the rectangularity decreases, the extent of the internal tearing is so great that it leads to a deterioration in quality of the cast strand and in an extreme case renders its disposal as scrap material necessary. This problem becomes increasingly relevant when using high-speed continuous casting facilities.

Various approaches have been proposed to address this problem, such as: changing the geometry of the mould cavity to be closer to the contraction rate of the metal being cast, changing cooling of the mould strand, or changing the steel composition. Although a change in the chemical composition of steel alloy for high-speed continuous casting may appear to be sound, the downside is the increase in costs for the steel. Therefore, the approach normally taken heretofore is directed towards a modification of the mould cavity so that the cast strand can be solidified as evenly as possible. The shell growth of the cast strand, i.e. the solidification from outside to inside should occur as evenly as possible because uneven solidification of the cast strand is the cause for the rhombic configuration of the ideally rectangular cast strand. Fairly complicated geometric mould cavities have been proposed; rendering the overall production, however, more complex and incurring increased maintenance costs when the mould has to be refinished because of wear. (US 2007/0125511 A1).

It would therefore be desirable and advantageous to provide an improved mould for the continuous casting of metal to obviate prior art shortcomings and to enable realization of a cast strand with superior shape accuracy without the need to change the composition of the metal alloy of the cast strand.

SUMMARY OF THE INVENTION

According to one aspect of the present invention, a continuous casting mould for casting a strand of metal, comprising a sidewall having an inner circumference to define a mould cavity which has a pouring opening for liquid metal and an outlet opening for a cast strand, the mould cavity having a cross section sized to correspond to a basic shape of the cast strand, the sidewall being provided with a profiling that extends in a casting direction and is configured as a corrugation to form grooves extending in substantial parallel relationship from the pouring opening to the outlet opening of the mould cavity, wherein a ratio of the inner circumference of the mould cavity to a width of each of the grooves is greater than 30, and wherein the width of the groove is in the range of 1.5 mm to 30 mm.

The profiling is configured as corrugations having several grooves or channels extending in substantially parallel relationship. These grooves extend over the effective length of the mould cavity and are provided in the region in which liquid metal comes into contact with the mould cavity. Thus, the grooves need not necessarily extend up to the upper rim of the pouring opening but may commence at a distance to the pouring opening so long as the grooves commence above the so-called meniscus. The meniscus represents the casting level to which the mould cavity is filled with liquid metal. The effective length of the mould should be sized long enough to enable a withdrawal of sufficient heat quantity from the liquid metal and thus to enable formation of a sufficiently firm shell of the cast strand so that it can support the contained liquid steel inside. The theoretical casting level is therefore situated in the upper third of the length of the mould cavity adjacent to the pouring opening, especially in the region of the upper 20% of the length.

It has been shown as very advantageous when the ratio of the inner circumference of the mould cavity to the width of an individual groove is greater than 30, with the width of the individual grooves ranging from 1.5 to 30 mm.

An improved stability of shape or decreased tendency to form a rhombic shape can basically be ensured with an increase in the number of grooves distributed over the inner circumference of the sidewall of the mould cavity. Tests have shown that the number of grooves should be selected to prevent the width of individual grooves to become too small. For the grooves to be effective, the width of a groove has a lower limit of about 1.5 mm. Currently preferred is a width of the grooves of greater than 2 mm and especially greater than 4.5 mm.

Conversely, the grooves should also not be too broad as an increase in the width results in a decrease in the number of grooves and thereby adversely affecting the guidance of the cast strand. It has been shown that a width of 30 mm should not be exceeded. Advantageously, the grooves are made significantly narrower and have a width of up to 15 mm, especially of up to 13 mm.

The precise number, geometry, and disposition of individual grooves depend on many factors and may vary from application to application. Factors include the geometry of the mould cavity, the inner circumference of the mould cavity, temperature control and cooling pattern of the metal being cast, lubrication and excitation of vibrations of the mould. Common to all applications is however that the profiling in the form of a corrugation superimposes the base geometry of the mould so as to produce as end product a cast strand having a surface which receives a distinct contour by the profiling and has longitudinal ridges with a geometry as a result of the groove pattern or corrugation of the mould cavity.

Continuous casting moulds typically have a conicity to suit shrinkage of the cast strand caused by cooling. As a result, the inner circumference of the mould cavity is smaller at the outlet opening than in the region of the meniscus. In accordance with the invention, the profiling is suited to the geometry of the mould cavity. In other words, the number of grooves of the profiling remains constant, although the mutual distance of the grooves slightly changes in correspondence with the geometry of the mould in casting direction. As a consequence, the individual grooves do not extend absolutely parallel to one another but extend at a very small acute angle to one another in correspondence with the geometry of the mould. The geometry of the mould may vary in casting direction and also over the inner circumference of the mould cavity; it even may decrease to 0% per meter. In other words, the grooves extend in parallel relationship in a length zone with the taper of 0% per meter, while extending only in substantial parallel relationship in other length zones in correspondence with the geometry. Moreover, the mould can have a curved configuration, in which case the grooves follow, of course, the curvature and the geometry at the same time.

The basic shape of the mould cavity and the geometry of the mould cavity can be established essentially independently from the configuration of the profiling. The profiling superimposes only this base configuration including the geometry, comparable with an elastic cover that conforms to the dimension and pattern of the mould cavity. It is only required to ensure that the grooves maintain their relative position within the transverse planes of the mould cavity so that the grooves virtually move closer to one another in a transverse plane which lies further below in casting direction.

There are many ways to configure the geometry of the individual grooves. The grooves can have a contour that is easy to make and enables liquid metal to easily bear upon the mould wall. Grooves within the meaning of the invention thus do not involve narrow deep slots with a mouth. Advantageously, the grooves have their deepest point in the center of the respective groove, with the depth continuously decreasing to the borders of the grooves. The transition from the deepest point of a groove to the groove rim is in particular continuous, i.e. without jumps. Also the transition between immediately adjacent grooves can be continuous, i.e. without jumps. Advantageously, adjacent grooves have a sinusoidal cross sectional pattern.

According to another advantageous feature of the present invention, the grooves may have a serrated cross section. In other words, the walls of the mould cavity have a cross section of virtually zigzag configuration. The zigzag shape relates hereby to a configuration in which several grooves with triangular cross section immediately adjoin one another so that several triangular grooves are juxtaposed.

It is, of course, also possible to combine several groove shapes with one another. It is also possible to combine various groove geometries, in particular groove widths, with one another.

It is therefore possible within the scope of the present invention to configure some grooves and/or groups of grooves with different depths, also designated as amplitude. Furthermore, depending on the application at hand, the grooves can be arranged at greater distance to other grooves or combined to groups. Individual groups may also be positioned at greater distance from other groups. In other words, it is possible to provide different spacing between individual grooves.

The grooves can be dispersed over the inner circumference of the mould cavity in symmetry to the longitudinal center axis or centerline of the mould cavity cross section. Thus, a mirror axis would intersect this centerline in an axis-symmetrical distribution.

It is, of course, also possible within the scope of the present invention to provide an asymmetric or uneven distribution of the individual grooves over the cross section of the mould cavity.

The advantages of profiling the continuous casting mould according to the present invention are especially apparent when complying with particular geometric conditions, especially when the mould has a cavity with rectangular cross section. In these fairly common cross sectional configurations, optimal correlations between width and depth of the individual grooves can be governed by the following equation:

$$W=K\times SR^{K2}$$

wherein:

K and K2 are constant factors,

SR is a side ratio between the longer side and the shorter side.

When L1 is the length of the longer side of the mould cavity and L2 designates the length of the shorter side of the mould cavity, the side ratio SR is governed by the following equation:

$$SR=L1/L2.$$

The selection of the constant factor K depends on the magnitude of the amplitude or depth of the individual grooves. At an amplitude in a range from 0.5 to 1 mm, the factor K ranges from 3 to 12. At an amplitude in a range from 1.5 to 2.5 mm, the constant factor K ranges from 6 to 13. At an even greater amplitude in a range from 2.5 to 3.5 mm, the factor K ranges from 11 to 14.

The factor K2 differs for the longer side and for the shorter side. For the longer side, the factor K2 ranges from 0.6 to 0.9. For the shorter side, the factor K2 ranges from −0.3 to −0.6. Thus, the width of the individual grooves differs on the longer and shorter sides of a rectangular mould.

In general, the depth of the individual grooves ranges from 0.5 to 5 mm. Currently preferred is a range from 1 to 3 mm.

Furthermore, the grooves should have a flank angle that is not less than the slip plane angle at the groove connection point. The slip plane angle is defined as the arc tan(a/b), wherein "a" is the perpendicular distance between the connection point and the cavity centerline that runs parallel to the grooved face and "b" is the perpendicular distance between the point and the cavity centerline that is perpendicular to the grooved face. The flank angle is intended to express that the grooves are not too shallow but conversely should not be too deep in order to be able to attain the desired effect of guiding the cast strand and, in particular, to prevent the cast strand during shrinkage from getting jammed or from exerting excessive friction upon the mould. The flank angle is measured in relation to the normal upon the surface of the mould cavity, with this surface normal being oriented at the connection point of the respective groove. The flank angle lies in a range of 80° to 10°. Currently preferred is a range from 70° to 20°. When deviating from these angle ranges, friction of the cast strand upon the mould increases in an unwanted manner. While higher wear would still attain the goal of the invention to improve the shape accuracy, the service life of the mould would be adversely affected.

In accordance with the present invention, the individual grooves are realized by juxtaposing depressions to provide a ridge-like profiling having overall a sinusoidal course in cross section. A sinusoidal course involves curves that have a reversal point in the region of the flanks of the individual grooves. It has been shown that the flank angle for the connection point of the first two grooves and the last two grooves of the face lies within the range +/−50 within the values of the following table:

| Depth Indication in [mm] | Side Ratio L1/L2 | Long Side (L1) Indication in [°] | Short Side (L2) Indication in [°] |
|---|---|---|---|
| 1 | 1 | 47.4 | 47.4 |
| 1 | 2 | 28.2 | 64.6 |
| 1 | 3 | 19.6 | 72.3 |
| 2 | 1 | 49.7 | 49.7 |
| 2 | 2 | 30.0 | 65.8 |
| 2 | 3 | 20.8 | 73.0 |
| 3 | 1 | 51.0 | 31.70 |
| 3 | 2 | 31.7 | 67.0 |
| 3 | 3 | 21.99 | 73.7 |

The table shows that the flank angle for the long and short sides is the same when the groove depths are 1 or 2 mm and when a side ratio SR=L1/L2=1, i.e. at square moulds. As the groove depth or amplitude increases while the side ratios remain the same, the flank angle of the grooves increases only slightly on the long side whereas the flank angle on the short side decreases. As the side ratio increases, the flank angle gets smaller in the area of the long side and increases in the area of the short side.

Advantageously, the mean flank angle lies in the order of +/−5° in relation to the angles indicated in the table. Intermediate values can be interpolated.

The invention is generally applicable to any cross sectional contours of the mould cavity. The mould may thus have a round, square, rectangular, polygonal or other cross-section, for example also in the shape of the cross section of a section beam, for example double-T-beam.

It is to be understood that the invention may also involve a mould in the form of a plate mould in which separately manufactured plates are combined to form the mould cavity. However, currently preferred is a continuous casting mould which involves a mould tube made of uniform material and in one piece.

The mould according to the invention has the following benefits:

1. The mould design allows a more uniform growth of the strand shell.
2. The uniform growth of the strand shell and the improved guidance in the mould result in a cast strand with much less geometric deviations.
3. Wear of the mould is reduced so that maintenance intervals for the mould can be extended.
4. The improvement in the area of the mould cavity incurs less cost when reprocessing the mould. Moreover, reduced wear ensures higher product quality over a longer time period.
5. Furthermore, steel alloys having less expensive additional alloying elements can be cast, without adversely affecting shape stability of the cast strand. In the event alloying elements are required to be added, less expensive alloying elements can be used. In particular the content of manganese can be kept to a minimum.
6. A further advantage resides in the improved lubricant distribution as a result of the corrugation. Typically, if lubricant distribution is uneven, application of a greater amount of lubricant has been proposed in practice for safety reasons. Oil as lubricant however contributes to enhanced heat transfer so that the mould is subject to higher thermal stress. This may cause fatigue cracks in the area of the meniscus in the copper material of the mould. The provision of a corrugation in accordance with the present invention results in a better distribution so that overall less lubricant can be used. This, in turn, results in less thermal stress of the mould in the area of the meniscus and thus a longer service life of the mould.

The mould according to the invention may be caused to additionally vibrate by at least one oscillator to prevent the melt from adhering to the mould wall and to speed up production.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
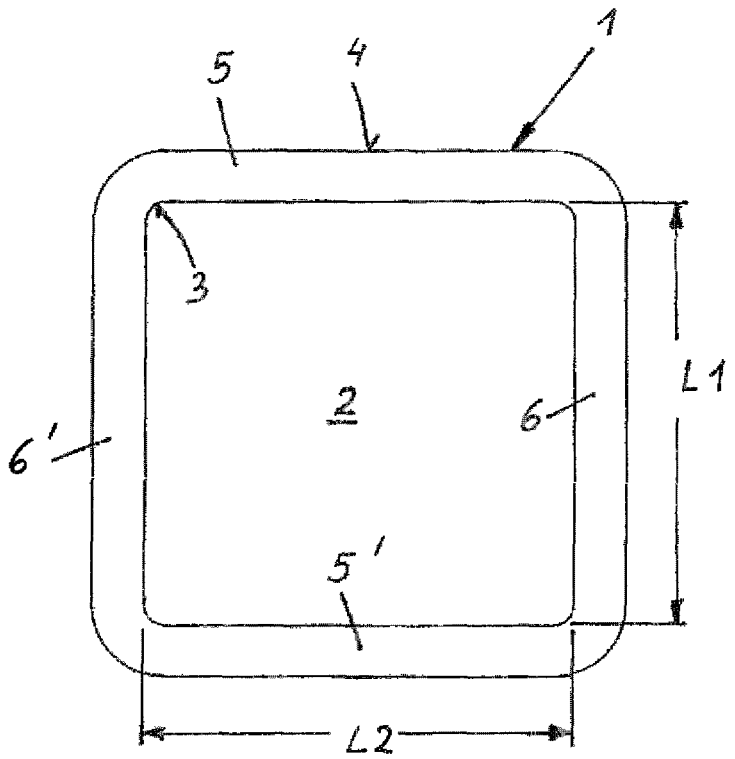
Fig. 1 PRIOR ART
FIG. 1 is a schematic illustration of a conventional mould.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 6:
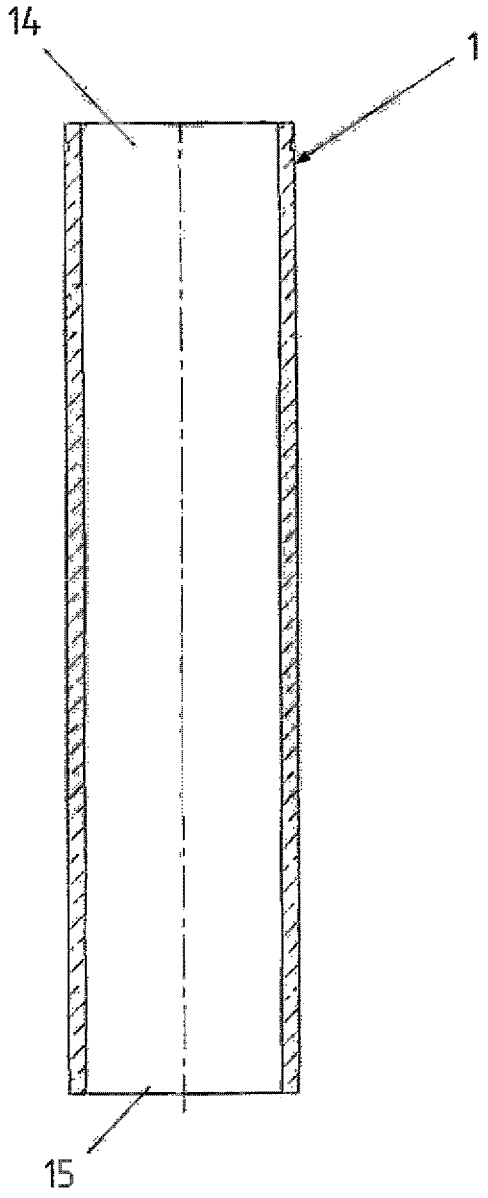
FIG. 6 is a longitudinal section of a mould according to the present invention.

Turning now to the drawing, and in particular to FIG. 1, there is shown a schematic illustration of a conventional mould 1 in the form of a tube mould for continuous casting of metal. The mould 1 has rectangular outer and inner cross sections. The mould cavity 2 is square in cross section and has a pouring opening 14 for liquid metal and an outlet opening 15 for a cast strand, as shown by way of example in FIG. 6. The corners 3 of the mould cavity 2 are rounded. Moulds of this type have a length of e.g. 1000 mm. The mould cavity 2 receives a metal melt that solidifies in casting direction within the mould cavity 2 into the cast strand. The cast strand progressively cools down from outside to inside and forms a so-called shell which grows from outside to inside as the melt solidifies until the strand is completely solidified. The mould is hereby cooled on its outer sides 4 in a manner not shown in detail. Normally this involves water-cooling. Of course, the provision of cooling bores within the mould wall or depressions on the outside for passage of a cooling fluid is conceivable as well.

The mould 1 depicted in FIG. 1 has a square configuration. The mould cavity 2 has two sidewalls of same length. The length L1 of opposite sidewalls 6, 6' is of same size as the length L2 of the opposite sidewalls 5, 5' that extend perpendicular to the sidewalls 6, 6'. The geometry of this exemplary embodiment is designated as base configuration of the mould cavity.

Figure 2:
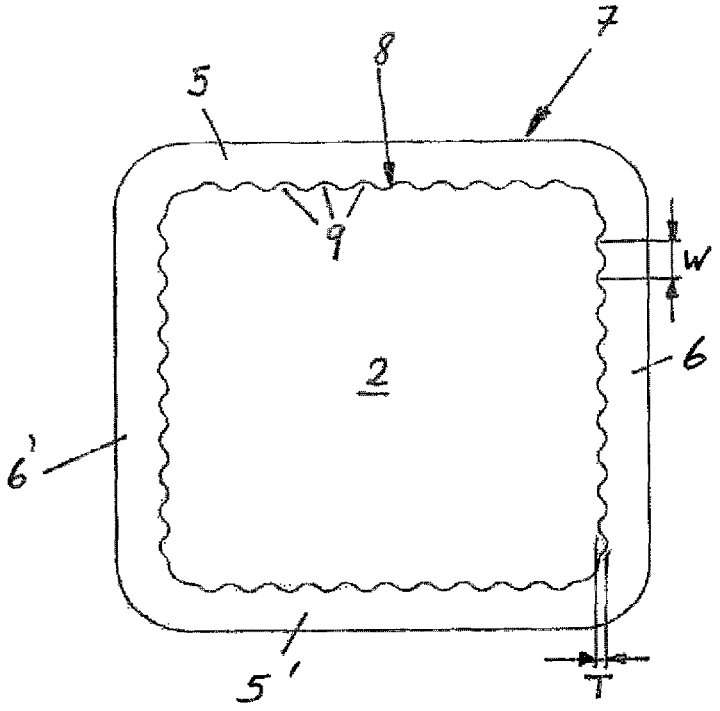
FIG. 2 is a schematic illustration of a first embodiment of a mould according to the present invention.

Referring now to FIG. 2, there is shown schematically a cross section of a first embodiment of a mould according to the present invention, generally designated by reference numeral 7. Parts corresponding with those in FIG. 1 are denoted by identical reference numerals and not explained again. The description below will center on the differences between the embodiments. In this embodiment, the base configuration is modified by providing the mould 7 with a profiling 8 in the area of its mould cavity 2 on the inside of the sidewalls 5, 5', 6, 6'. The mould cavity 2 has again a base configuration with square cross section. The proportions of the mould 7 remain unchanged compared to the mould 1 of FIG. 1. The same is true for any geometry (not shown in this drawing plane) or further characteristics of the mould 7, with the exception of the profiling 8.

The profiling 8 is configured as corrugation comprised of juxtaposed grooves 9. The grooves 9 have a sinusoidal cross section and immediately adjoin one another so that the surface of the mould cavity 2 on the inside is corrugated in a sinusoidal fashion in cross section and circumferential direction.

In this exemplary embodiment, all grooves 9 have identical groove width W and identical groove depth T, also called amplitude. This exemplary embodiment has a total of 40 grooves, with each the sidewalls 5, 5', 6, 6' having 10 grooves. As a result of the sinusoidal course in circumferential direction, the grooves 9 have all the width W and a same spacing that also corresponds to the dimension W.

Figure 3:
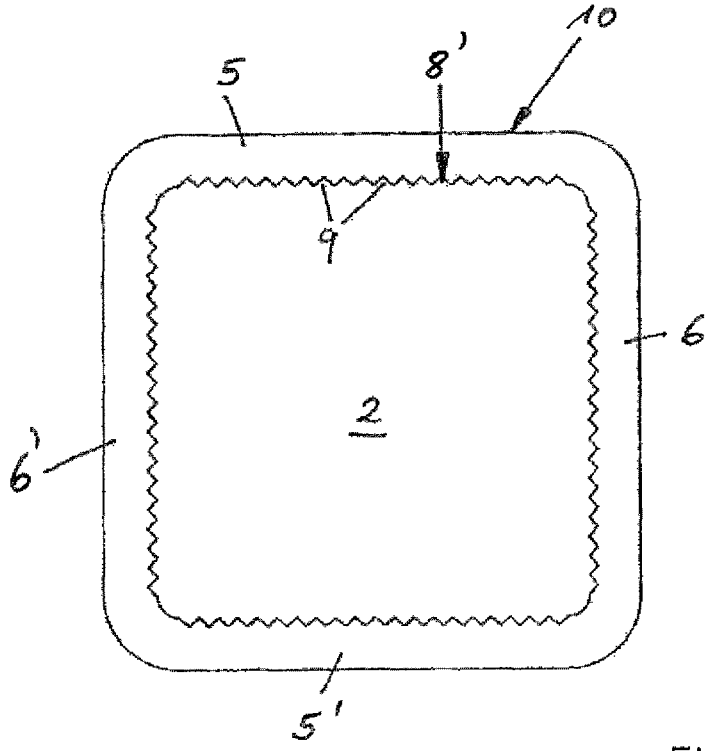
FIG. 3 is a schematic illustration of a second embodiment of a mould according to the present invention.

FIG. 3 shows schematically a cross section of a second embodiment of a mould according to the present invention, generally designated by reference numeral 10 and differing from the mould 7 of FIG. 2 only by the configuration of the grooves 9. In this embodiment, the grooves 9 of the mould 10 have a serrated configuration as opposed to the sinusoidal configuration of the grooves 9 of the mould 7. Each groove 9 of the mould 10 has thus a triangular cross section so as to establish overall a profiling 8' of zigzag configuration.

A comparison between FIGS. 2 and 3 shows that the number of grooves 9 of the mould 10 is greater than the number of grooves 9 of the mould 7. Still, the width of the grooves 9 of the mould 10 should not be too small and should not fall below a width of 1.5 mm. Preferably, the width of the grooves 9 of the mould 10 range from 1.5 to 30 mm, especially 2 to 15 mm. Currently preferred is a width in the range from 4.5 to 13 mm.

Figure 4:
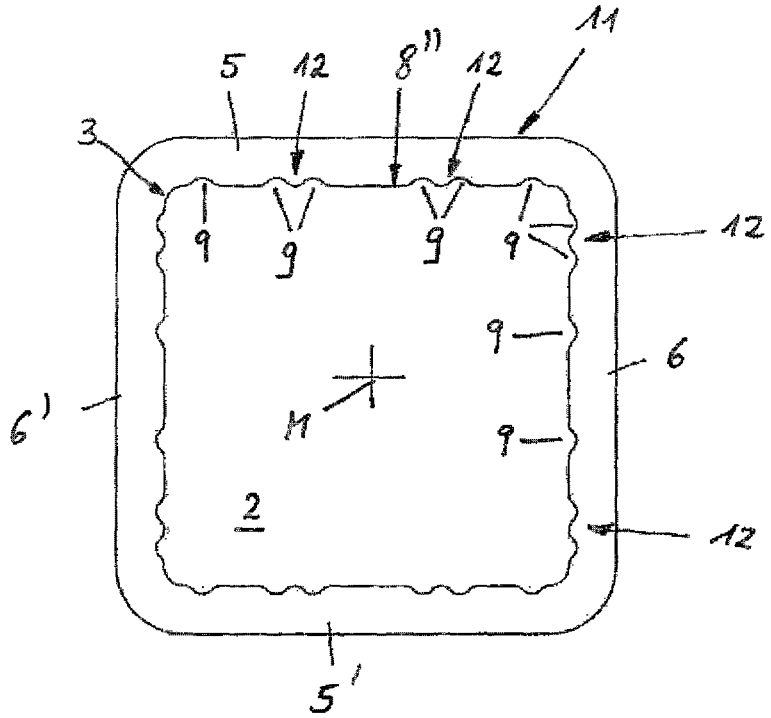
FIG. 4 is a schematic illustration of a third embodiment of a mould according to the present invention.

FIG. 4 shows schematically a cross section of a third embodiment of a mould according to the present invention, generally designated by reference numeral 11 and having on the inside of the sidewalls 5, 5', 6, 6' a profiling 8" which differs from the profiling 8 of the mould 7 of FIG. 2 by the provision of grooves 9 which are also sinusoidal in cross section but arranged at varying distances from one another. For example, the upper sidewall 5, as viewed in the drawing plane, has two groups 12 in spaced-apart disposition and each having two grooves 9. Towards each of the corners 3, there is arranged a further single groove 9. The spacing between the two individual grooves 9 of each group 12 is smaller than the spacing between the two groups 12 of grooves 9.

The reverse configuration is provided on the inside of the sidewalls 6, 6' which extend perpendicular to the sidewalls 5, 5'. The groups 12 of two grooves 9 each are located at the margins, i.e. in the area of the corners 3, whereas the single grooves 9 are located closer to the center. Overall, the grooves 9 and the groups 12 are arranged in symmetry. A respective mirror axis would intersect the centerline M of the mould cavity 2 oriented into the drawing plane.

Figure 5:
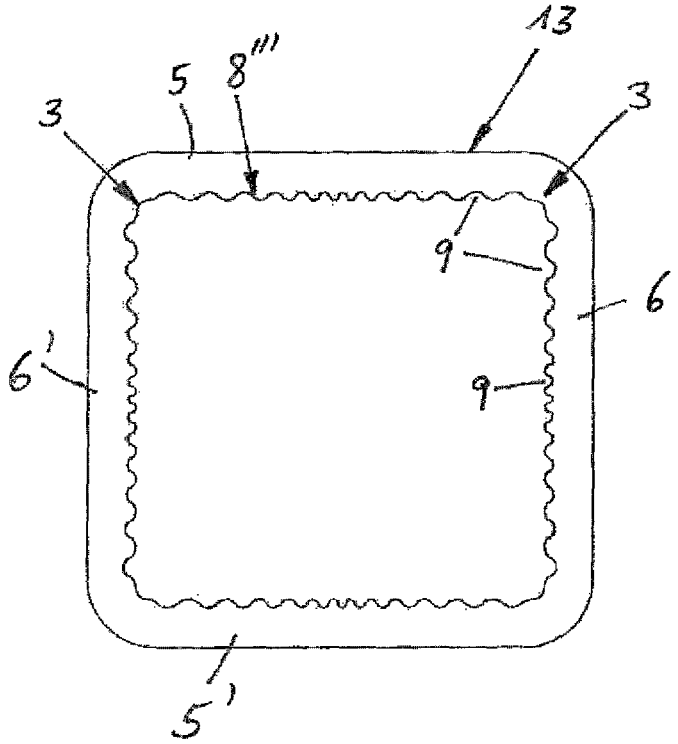
FIG. 5 is a schematic illustration of a fourth embodiment of a mould according to the present invention.

FIG. 5 shows schematically a cross section of a fourth embodiment of a mould according to the present invention, generally designated by reference numeral 13 and having on the inside of the sidewalls 5, 5', 6, 6' a profiling 8''' which differs from the afore-described profilings 8, 8', 8". This embodiment involves not only a variation in the width W that decreases from the corner areas 3 towards the middle of each of the sidewalls 5, 5', 6, 6' but also a variation in the amplitude or depth T of the individual grooves 9. The depth T of the grooves 9 of the mould 13 is substantially greater in the area of the corners 3 than the depth of the grooves 9 in midsection of each of the sidewalls 5, 5', 6, 6'. Thus, the grooves 9 in midsection not only are of smallest depth T but also their width is the smallest, with the depth and width increasing from the center in the direction of the corners 3. The depth 7 ranges in the moulds 7, 10, 11, 13 from 1 to 3 mm.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A continuous casting mould for casting a strand of metal, comprising a sidewall having an inner circumference to define a mould cavity which has a pouring opening for liquid metal and an outlet opening for a cast strand, said mould cavity having a cross section sized to correspond to a basic shape of the cast strand, said sidewall being provided with a profiling that extends in a casting direction and is configured as a corrugation to form grooves extending in substantial parallel relationship from the pouring opening to the outlet opening of the mould cavity, wherein a ratio of the inner circumference of the mould cavity to a width of each of the grooves is greater than 30, and wherein the width of each of said grooves is in the range of 1.5 mm to 30 mm, wherein the mould cavity is rectangular in shape, with the grooves extending in substantially uniform parallel relationship, wherein the width of the grooves are calculated based on the depth of the grooves according to the following equation:

$$W=K\times SR^{K2}$$

wherein K=constant factor

K2=constant factor

SR=L1/L2, with L1/L2>1 with L1=length of a longer side of the mould cavity

L2=length of a shorter side of the mould cavity, wherein K at a depth in a range of 0.5 to 1 mm is in a range of 3 to 12, wherein K at a depth in a range of 1.5 to 2.5 mm is in a range of 6 to 13, wherein K at a depth in a range of greater than 2.5 to 3.5 mm is in a range of 11 to 14, wherein K2 is in a range of 0.6 to 0.9 in relation to the longer side of the mould cavity and falls in the range of −0.3 to −0.6 in relation to the shorter side of the mould cavity, wherein the width of the grooves on the longer side of the mold cavity is different from the width of the grooves on the shorter side of the mold.

2. The continuous casting mould of claim 1, wherein the width of each of the grooves is in the range of 2 mm to 15 mm.

3. The continuous casting mould of claim 1, wherein the width of each of the grooves is in the range of 4.5 mm to 13 mm.

4. The continuous casting mould of claim 1, wherein each of the grooves has a depth that increases continuously from a border of the groove to a center of the groove.

5. The continuous casting mould of claim 1, wherein the grooves are of sinusoidal shape in cross-section.

6. The continuous casting mould of claim 1, wherein the grooves are of serrated shape in cross-section.

7. The continuous casting mould of claim 1, wherein the grooves are different in shape.

8. The continuous casting mould of claim 1, wherein the grooves are different in width.

9. The continuous casting mould of claim 1, wherein the grooves or groups of grooves differ in depth or amplitude within a cross-section perpendicular to the casting direction.

10. The continuous casting mould of claim 1, wherein adjacent ones of the grooves or groups of adjacent grooves are positioned in different mutual distances.

11. The continuous casting mould of claim 1, wherein the grooves are located axially symmetrical in relation to an axis of reflection that intersects a centerline of the mould cavity cross section extending in the casting direction.

12. The continuous casting mould of claim 1, wherein the grooves are unevenly distributed in regard to the inner circumference of the mould cavity.

13. The continuous casting mould of claim 1, wherein the grooves have each a depth in a range of 0.5 to 5 mm.

14. The continuous casting mould of claim 1, wherein the grooves have each a depth in a range of 1 to 3 mm.

15. The continuous casting mould of claim 1, wherein the mould is of round, square, rectangular, polygonal cross-section or in a shape of a section beam in cross-section.

16. The continuous casting mould of claim 1, wherein the mould is a continuous casting mould tube.

17. The continuous casting mould of claim 1, wherein the mould is a continuous casting plate mould.

* * * * *